United States Patent [19]

Baker et al.

[11] 4,055,169

[45] Oct. 25, 1977

[54] VIBRATING STRAP

[76] Inventors: Richard E. Baker; Elizabeth F. Baker, both of 2701 Arlington Blvd., Apt. 101, Arlington, Va. 22201

[21] Appl. No.: 671,072

[22] Filed: Mar. 25, 1976

[51] Int. Cl.[2] ..... A61H 1/00

[52] U.S. Cl. ..... 128/32; 128/36

[58] Field of Search ..... 128/32–36, 128/41, 63, 24.2, 24.1

[56] References Cited

U.S. PATENT DOCUMENTS

| | | | |
|---|---|---|---|
| 2,113,444 | 4/1938 | Erickson | 128/36 |
| 2,198,872 | 4/1940 | Hegstrom | 128/36 |
| 2,347,554 | 4/1944 | Gothers | 128/36 |
| 2,574,945 | 11/1951 | Werner | 128/36 |
| 2,742,036 | 4/1956 | Montesano | 128/36 |
| 3,557,781 | 1/1971 | Kaye | 128/32 |

*Primary Examiner*—Lawrence W. Trapp

[57] ABSTRACT

A vibrating strap consisting of an outer component which is a thin, tough, more or less rectangular, flexible, tough strap with terminal and subterminal means for securing said strap around and/or over areas of the human body to be vibrated and is provided with an internal pad and means for securing a standard vibrator centrally onto the outer surface of said outer component. The pad consists of one or more thin, soft, resilient pieces separate from or bonded to the inner surface of said outer component. Said pad may consist of two or more pieces separated to provide space between. In preparation for use said outer component with said internal pad is wrapped around members of said human body and secured with subterminal snap-like means or oriented over areas of the human body to be vibrated and secured by terminal eyelet-like means. Pads designed with spaces between pieces are secured so that said spaces are oriented over sensitive areas of the human body. Thus said outer component holds said pad internally and said vibrator externally so as to comprise said vibrating strap.

5 Claims, 4 Drawing Figures

VIBRATING STRAP

BACKGROUND OF THE INVENTION

This invention relates to a VIBRATING STRAP and more particularly to a flexible strap outer component to which a standard vibrator is secured externally in a central location and an internal pad which is made of one or more thin, soft, resilient pieces separate from or bonded to the inner surface of the outer component of said VIBRATING STRAP. The outer strap component comprises a thin, roughly rectangular, flexible and tough strap on the outside of said pad. The ends of said outer component are secured together or held terminally or subterminally so that said pad is held in place around and/or over the area of the human body to be vibrated while said vibrator is secured externally to said outer component.

Vibrators as shown in the prior art are provided primarily with means for securing same to one hand of the operator while being moved about over the surface of that part of the body to be vibrated. Means are not provided as in the present invention for securing a vibrator directly to a specific area of the human body for the direct vibration thereof. The invention disclosed herein provides for such direct securing and vibration, thus eliminating the need for supporting the vibrator with one hand while in use. Said inner pad provides cushioning against excessively vigorous and/or uncomfortable effects of vibration. Thus the user can enjoy the effects of vibration treatment without holding said vibrating strap with either hand.

SUMMARY OF THE INVENTION

Generally the invention comprises a vibrating strap of three primary components: an outer strap, an inner pad, and a standard vibrator. The inner pad is made of one or more thin, soft, resilient pieces which are separate from or bonded to the inner surface of said outer strap and are wrapped around or oriented over that area of the body to be vibrated so that said pad fills the space between the surface area of the body to be vibrated and the inner surface of the outer strap. The standard vibrator is secured to the outer surface of the outer strap component. The ends of said outer strap are secured terminally with snaps or subterminally with eyelets, or the like, so that said outer strap component, said pad, and said vibrator are held in place securely and are properly oriented over and/or around the area of the body to be vibrated, and they act as a unit.

It is a primary object of this invention to provide a device for holding a standard vibrator so that any area of the body can be vibrated directly thereby without the need for said vibrator to be hand held.

It is a further object of this invention to provide outer straps and inner pads of several dimensions so as to meet the requirements of any user.

It is a further object of this invention to provide padding between the area of the body to be vibrated and the outer strap component which holds the vibrator externally so as to cushion against excessively vigorous and/or uncomfortable effects of the vibrator acting with the outer strap component.

Further objects and advantages of the invention will become apparent upon a detailed description thereof with reference to the accompanying drawings wherein:

DESCRIPTION OF A PREFERRED EMBODIMENT

Figure 1:
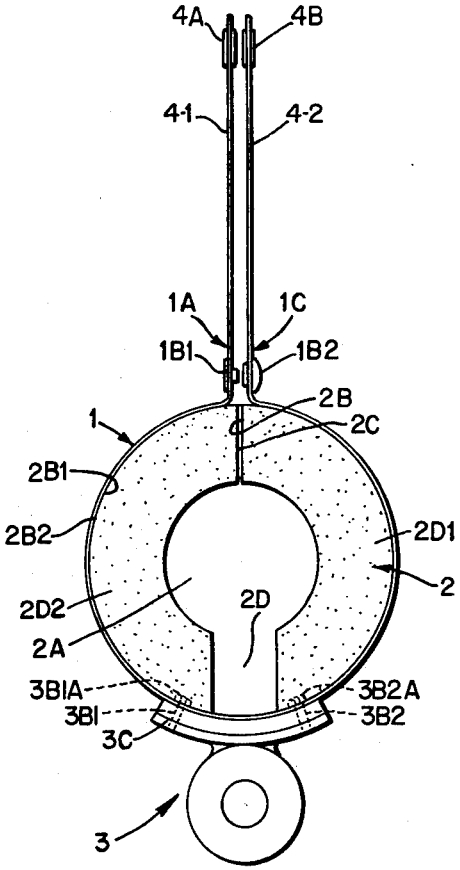
FIG. 1 is an end view of the device of the subject invention.

In FIG. 1 the vibrating strap components are shown in end view. They comprise an outer component 1, an internal pad generally at 2, and a standard vibrator generally at 3. The pad, generally at 2, is made in the form of two strips 2D1 and 2D2 which are more or less narrow, elongated, or somewhat rectangular, soft, resilient, enclosing the central space 2A (which would be occupied by the member of the body to be vibrated) and said space 2A joins space 2D which is oriented over any sensitive area of proper dimensions and general conformation to be so oriented. The outer component generally at 1 comprises a more or less narrow, elongated, thin, tough, flexible strap of which the areas 1A and 1C, with pad ends 2B and 2C can be secured together by snaps (one pair is shown in end view at 1B1 and 1B2). The areas 1A and 1C extend out to form triangular areas 4-1 and 4-2 with eyelets 4A and 4B respectively near their termini. The inner surface 2B1 of the outer component 1 is bonded to the outer surface 2B2 of the internal pad generally at 2. The standard vibrator generally at 3 is secured to the outer component with securing devices, such as machine screws shown at 3B1 and 3B2, which secure together one end (or one side) of base 3C of said vibrator shown generally at 3 to said outer component through the outer component perforations 3B1A and 3B2A and is held externally thereby.

Figure 2:
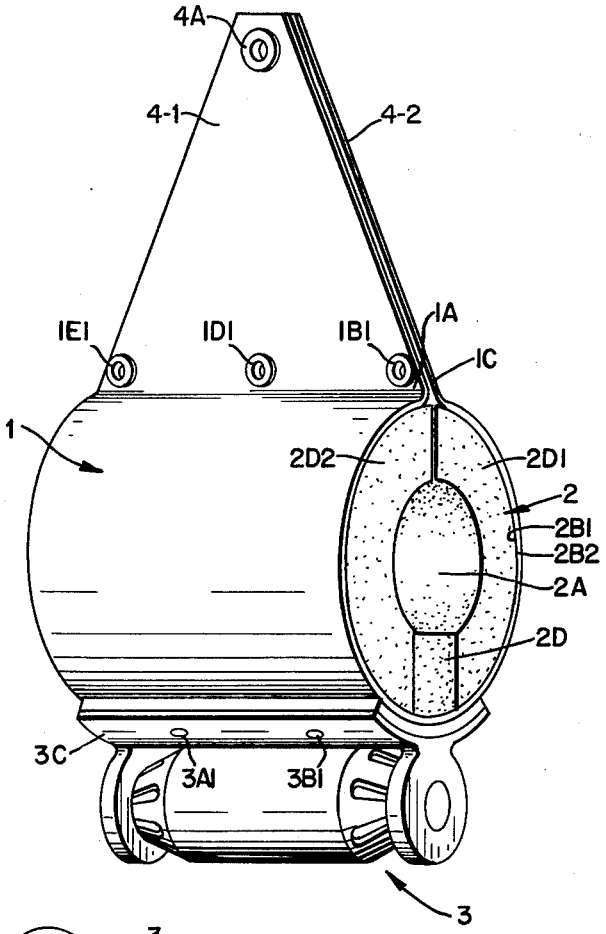
FIG. 2 is a side and partial end perspective view of the device shown in FIG. 1.

In FIG. 2 the vibrating strap components are shown in side view. The securing area 1A of outer component 1 is held against securing area 1C with snaps 1B1, 1D1, and 1E1, and the pad ends 2D1 and 2D2 are thus held against each other. The inner surface 2B1 of said outer component at 1 is bonded to the outer surface 2B2 of the pad generally at 2 which encircles the central space 2A (which would be occupied by the member of the body to be vibrated) and said space 2A joins space 2D which is oriented over sensitive areas of the human body to be vibrated. Outer component 1 extends up beyond area 1A to include area 4-1 with eyelet 4A near the terminus and beyond area 1C to include area 4-2 with eyelet 4B (shown in FIG. 3). Said vibrating strap can be secured additionally or alternatively through said eyelets 4A and 4B. The base of the standard vibrator 3C of the standard vibrator generally at 3 is secured externally to said outer component 1 with securing devices such as the machine screws at 3A1 and 3B1 through the perforations 3A1A and 3B1A respectively, which are shown in FIG. 4.

Figure 3:
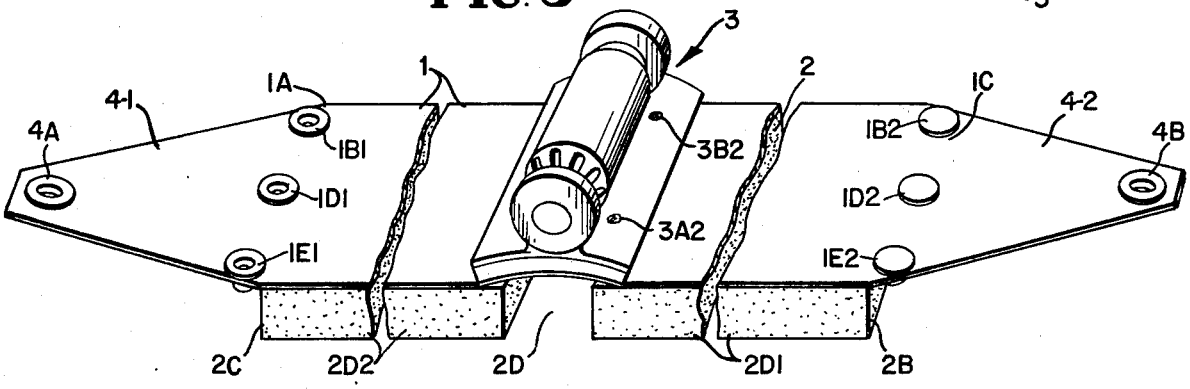
FIG. 3 is a perspective view of the outer surface of the vibrating strap with vibrator.

In FIG. 3 the vibrating strap is shown in side perspective view as it would be oriented for securing over the surface of an area of the body to be vibrated but not wrapped around said area. The outer component is shown at 1 and the inner pad at 2. The snap areas at 1A and 1C are shown at opposite ends of the outer component and would not be utilized for securing means in such an orientation of said vibrating strap. For securing said vibrating strap when so oriented eyelets 4A and 4B of triangular areas 4-1 and 4-2 respectively would be secured as required to hold said vibrating strap in place in an open form as shown (not wrapped around the area of the body to be vibrated). The snaps are shown at 1B1, 1B2, 1D1, 1D2, 1E1, and 1E2 and would not be utilized with said open form. The two halves 2D1 and 2D2 of the internal pad 2 are separated by space 2D and extend outward from said space 2D to the respective ends 2B and 2C. The standard vibrator generally at 3 is secured on one side as shown with machine screws at 3A2 and 3B2.

Figure 4:
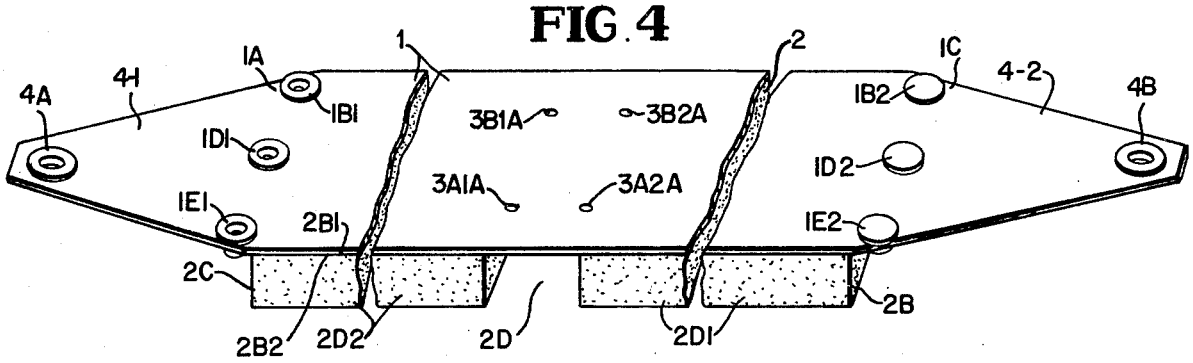
FIG. 4 is a perspective view of the outer surface of the vibrating strap without the vibrator.

In FIG. 4 said outer component generally at 1 illustrates the outer surface 1. One side of said vibrating strap and one end (2B) are shown in perspective (without the vibrator). The areas 1A and 1C are provided with snaps in pairs 1B1 with 1B2, 1D1 with 1D2, and 1E1 with 1E2 for securing areas 1A and 1C together when in a wrap-around form. Said outer component is provided with eyelets 4A and 4B terminally in areas 4-1 and 4-2 respectively for securing means in an open form as shown. Said outer component is provided also with perforations at 3A1A, 3A2A, 3B1A, and 3B2A through which the base (3C in FIGS. 1 and 2) of the standard vibrator generally at 3 in FIGS. 1 and 2 is secured externally to said outer component 1. The inner surface 2B1 of said outer component 1 is bonded to the outer surface 2B2 of the internal pad which is made in two parts 2D1 and 2D2 which are separated by the space 2D and extend outward from 2D to the ends 2B and 2C. Sensitive areas of the body would be oriented within space 2D and secured there while adjacent areas of the body to be vibrated are oriented under the two parts 2D1 and 2D2 of said internal pad. Such an orientation will allow for vibration without direct pressure from said pad on relatively small, sensitive areas of the human body.

It should be obvious to those skilled in the art that the vibrating strap could be made with modifications of the preferred embodiment as described hereinbefore without altering the basic concept of this invention. Custom made pads with cut-out areas could be used in place of said internal pad as described hereinbefore. Said cut-out areas would fit around and over sensitive areas of the human body to be vibrated without touching such areas.

What is claimed is:

1. A VIBRATING STRAP comprising:

a strap-like outer component more or less rectangular in shape, thin, flexible, and provided with securing means at each end which hold said component so that its inner surface is oriented around and/or over areas of the human body to be vibrated;

subterminal snap-like means for securing together the two ends of said strap-like outer component so that said vibrating strap can be oriented and secured around a much smaller member of said human body to be vibrated;

centrally located means for securing a standard vibrator over the outer surface of said component; and a pad-like inner component which is soft and resilient, the outer surface contiguous with the inner surface of said strap-like component, and the inner surface oriented around and/or over and in direct contact with areas of the human body to be vibrated.

2. A vibrating strap as defined in claim 1 wherein said pad-like inner component comprises two or more pieces separated to create space between said pieces so that said space can be oriented over sensitive areas of said human body to be vibrated to avoid direct contact with said pad-like inner component.

3. A vibrating strap as defined in claim 1 wherein said strap-like outer component isprovided with eyelet-like terminal means for securing said vibrating strap over areas of said human body the dimensions and/or conformation of which preclude the use of said subterminal securing means.

4. A VIBRATING STRAP as defined in claim 1 wherein said strap-like outer component is provided centrally with perforations through which machine screws secure said standard vibrator to and over the outer surface of said outer component.

5. A VIBRATING STRAP as defined in claim 1 wherein the outer surface of said pad-like inner component is bonded to the inner surface of said strap-like outer component.

* * * * *